United States Patent [19]

Sammons

[11] Patent Number: 5,052,141

[45] Date of Patent: Oct. 1, 1991

[54] TRIGGER TENSION ADJUSTER

[76] Inventor: Hal C. Sammons, Rte. 3, Box 784, Tahlequah, Okla. 74464

[21] Appl. No.: 566,049

[22] Filed: Aug. 10, 1990

[51] Int. Cl.[5] ..... F41A 19/17

[52] U.S. Cl. ..... 42/69.01

[58] Field of Search ..... 42/69.01, 69.02, 69.03, 42/41, 65, 42.01, 42.02, 42.03

[56] References Cited

U.S. PATENT DOCUMENTS

| | | | |
|---|---|---|---|
| 859,974 | 7/1907 | Von Pocci | 42/69.03 |
| 2,126,076 | 8/1938 | Wright et al. | 42/69.02 |
| 2,274,195 | 2/1942 | Garrison | 42/69.01 |
| 2,365,440 | 12/1944 | Seitz | 42/69.02 |
| 2,387,788 | 10/1945 | Wiles | 42/69.02 |
| 2,654,175 | 10/1953 | Hansen | 42/69.03 |
| 2,909,100 | 10/1959 | Kennerley-Tayler | 42/69.02 |
| 2,965,993 | 12/1960 | Perrine | 42/69.02 |
| 3,755,951 | 9/1973 | Koon, Jr. | 42/69.02 |
| 3,950,876 | 4/1976 | Wild et al. | 42/69.02 |
| 4,005,540 | 2/1977 | Robinson | 42/69.01 |
| 4,391,058 | 7/1983 | Casull | 42/69.02 |
| 4,625,444 | 12/1986 | Beretta | 42/69.02 |

FOREIGN PATENT DOCUMENTS

| | | | |
|---|---|---|---|
| 2260171 | 6/1974 | Fed. Rep. of Germany | 42/69.02 |
| 3639746 | 5/1988 | Fed. Rep. of Germany | 42/69.01 |

*Primary Examiner*—Michael J. Carone
*Attorney, Agent, or Firm*—Head & Johnson

[57] ABSTRACT

A trigger tension adjuster for use with a factory made trigger assembly which includes a trigger housing on which a trigger is pivotally mounted with a shoulder on the trigger accessible within the housing. The adjuster to be added to the trigger assembly includes a mounting block which has a front portion contoured to abut the rear and interior surfaces of the housing sidewalls and a rear shelf-like portion which will extend in spaced relationship above the trigger shoulder. The mounting block is secured to the housing and a spring biased plunger is threaded through the shelf-like portion so that the plunger is in engagement with the shoulder of the trigger. Thus, the weight of the trigger pull is controlled solely by the compression of the spring biasing the plunger against the trigger shoulder. When the depth of the plunger assembly is properly set, a set screw through the mounting block permits the user to secure the plunger at the appropriate depth. Thus, in the field, to adjust the trigger pull, the user need only loosen the set screw, rotate the plunger assemlby in its threads until the desired tension is attained and retighten the set screw. This can all be done with a single allen wrench compatible to both the set screw and the plunger assembly.

9 Claims, 2 Drawing Sheets

TRIGGER TENSION ADJUSTER

BACKGROUND OF THE INVENTION

This invention relates generally to trigger devices for firearms and more particularly concerns mechanisms adjustable to vary the trigger pull or tension of competition firearms.

The trigger pull of a factory made trigger device is not easily maintained at a constant poundage. As parts of the trigger mechanism wear, the pull gets lighter and there is presently no way to adjust it in the field. Frequently, parts of the mechanism may wear so severely that it becomes necessary to replace the trigger entirely.

This becomes a particular problem for competition shooters since constant sensitivity of their trigger pull is extremely important while the repetitive use of competition shooting increases the wear and therefore the inconsistency.

As a consequence, competition shooters frequently have their trigger mechanisms at the gunsmith shop for replacement of parts and tension adjustment. This is a relatively expensive process and there are few gunsmiths skilled to meet the requirements of the competition shooter. Furthermore, even if a gunsmith has been able to make the appropriate adjustment, use during a single competition may cause the tension to vary, leaving the shooter with little option other than to carry replacement trigger mechanisms to the competition or use the loose tension device.

Adjustable trigger tension mechanisms are known in the prior art, but they are very complex and not capable of user adjustment in the field. Accordingly, it is an object of this invention to provide a trigger tension adjuster operable by the user in the field to adjust the trigger pull of a weapon.

SUMMARY OF THE INVENTION

In accordance with the invention, a trigger tension adjuster is provided for use with a factory made trigger assembly which includes a trigger housing on which the trigger is pivotally mounted. A shoulder on the trigger is accessible within the housing. The trigger tension adjuster kit to be added to the assembly includes a mounting block which has a front portion contoured to abut the rear and interior surfaces of the housing sidewalls and a rear shelf-like portion which will extend in spaced relationship above the trigger shoulder. The mounting block is secured to the housing and a spring biased plunger is threaded through the shelf-like portion so that the plunger is in engagement with the shoulder of the trigger. Thus, the weight of the trigger pull is controlled solely by the compression of the spring biasing the plunger against the trigger shoulder. When the depth of the plunger assembly is properly set, a set screw through the mounting block permits the user to secure the plunger at the appropriate depth. Thus, in the field, to adjust the trigger pull, the user need only loosen the set screw, rotate the plunger assembly in its threads until the desired tension is attained and retighten the set screw. This can all be done with a single allen wrench compatible to both the set screw and the plunger assembly.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
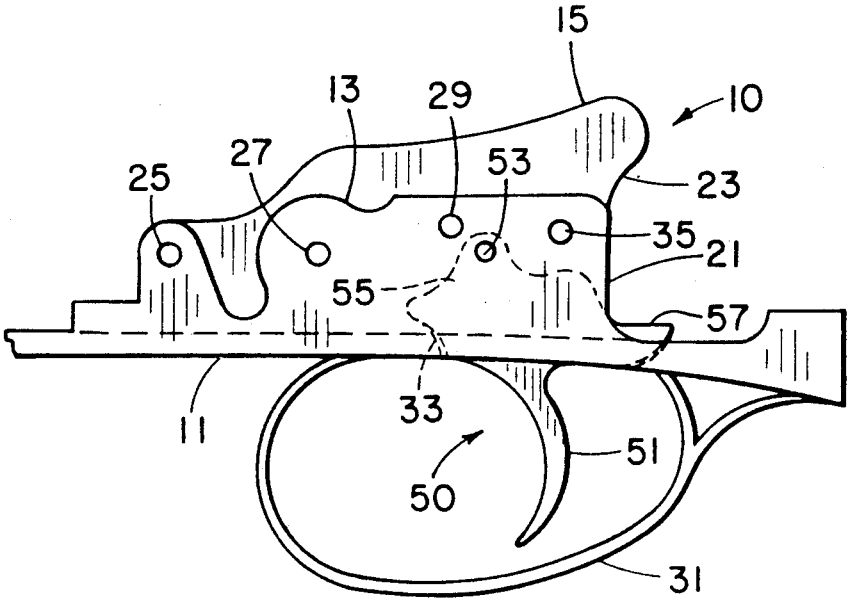
FIG. 1 is a side elevation of a factory made trigger housing.
Figure 2:
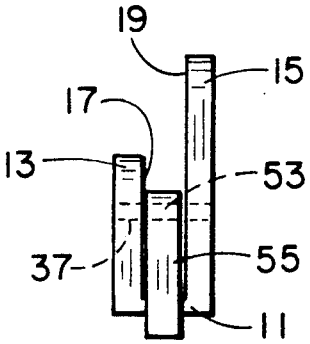
FIG. 2 is a rear elevation of the housing of FIG. 1.
Figure 3:
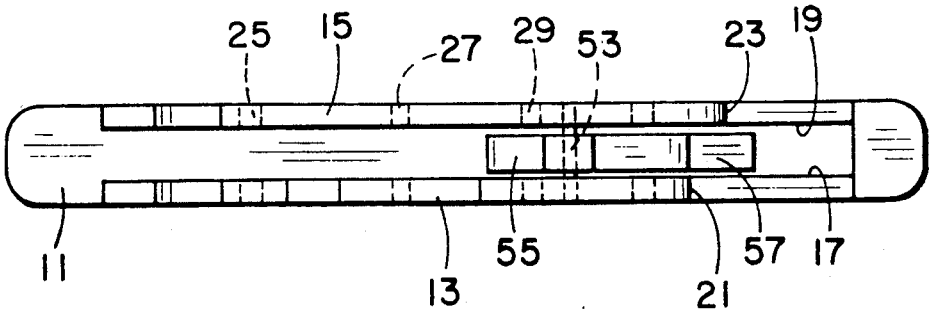
FIG. 3 is a top view of the housing of FIG. 1.
Figure 4:
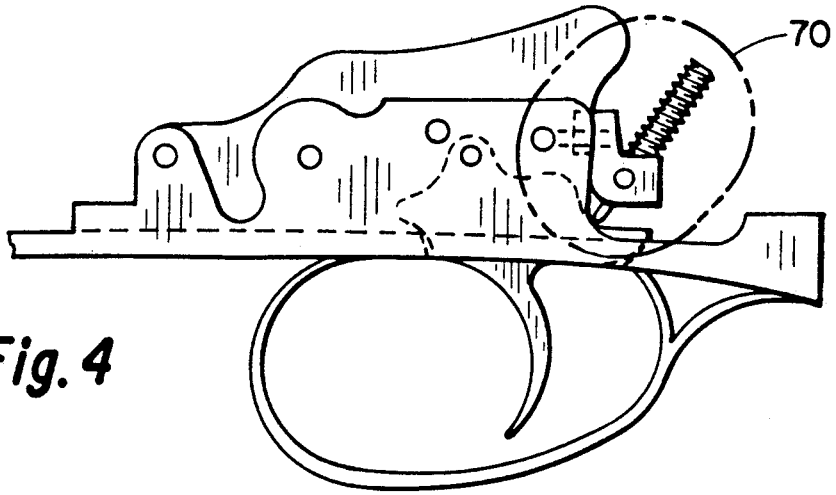
FIG. 4 is a side elevation of the housing of FIG. 1 with a preferred embodiment of the trigger tension adjuster mounted on the housing.
Figure 5:
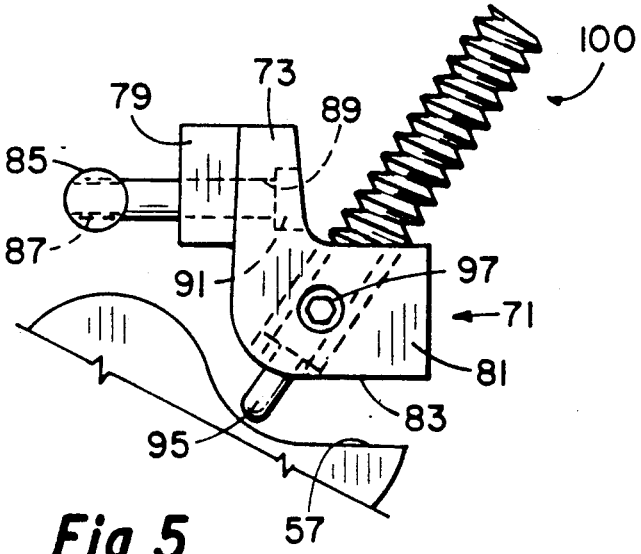
FIG. 5 is an enlarged side elevation of the trigger tension adjuster of FIG. 4.
Figure 6:
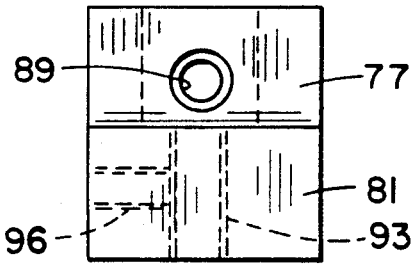
FIG. 6 is a rear elevation of the mounting block of FIGURE 5.
Figure 7:
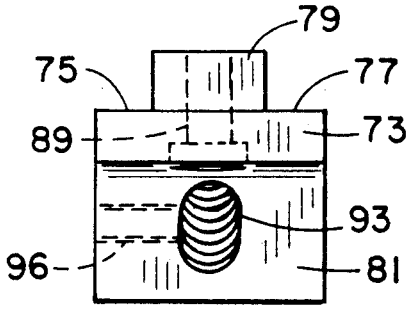
FIG. 7 is a top view of the mounting block of FIG. 5.

Turning first to FIGS. 1 through 3, a factory made trigger housing for use with a competition shotgun such as the TMI Perazzi is illustrated. The housing 10 includes a base portion 11 and a pair of side walls 13 and 15 with their interior surfaces 17 and 19 spaced apart. The side walls 13 and 15 have upwardly extending rear portions 21 and 23 and a plurality of transverse holes 25, 27 and 29 through which pins (not shown) may be inserted to secure the components of the trigger assembly (not shown) within the housing 10. The housing 10 also generally includes a trigger guard 31 which extends ovately under the main body of the trigger housing 10. A slot 33 in the base portion 11 of the housing 10 between the side walls 13 and 15 permits the lower portion 51 of the trigger 50 to extend below the housing 10 into the guard 31. The trigger 50 is pivotally mounted to the housing lo by a trigger pin 53 through the upper portion 55 of the triqger 50. The rear portion of the trigger 50 has a shoulder 57 which extends behind the rear portions 21 and 23 of the housing side walls 13 and 15. Thus, when the lower portion 51 of the trigger 50 is pulled, it can be seen that the trigger 50 will rotate about the trigger pin 53 and cause the shoulder 57 to rotate upwardly in relation to the pin 53.

As it comes from the factory, the housing 10 includes the trigger pin 35 which extends transversely through the housing side walls 13 and 15 in the holes 37 at the rear of the housing 10. This pin 35 is of solid construction and is used to engage a spring (not shown) to the upper portion of the trigger 50 which biases the trigger 50 to its forward release position.

Turning now to FIGS. 4 through 7, there is illustrated a preferred embodiment of the trigger tension adjuster 70 for use with the housing 10 illustrated in FIGS. 1 through 3. The trigger tension adjuster 70 includes a mounting block 71 which has a front portion 73 contoured for secure engagement with the trigger housing 10. In this preferred embodiment, the mounting block 71 has a front portion 73 with side portions 75 and 79 contoured to abut the rear portions 21 and 23 of the housing sidewalls 13 and 15. In addition, the front portion 73 has a forward extension 79 which is contoured to snugly fit between the sidewalls 13 and 15 of the housing 10. Thus, with the forward extension 79 inserted into position between the housing sidewalls 13 and 15 and the mounting block side portions 75 and 77 in abutment with the rear portions 21 and 23 of the housing 10, the mounting block 71 will be in a substantially stable condition in relation to the housing 10. The mounting block 71 further includes a rearwardly extending lower shelf portion 81 having its bottom surface 83 spaced above and contoured similarly to the trigger shoulder 57.

The trigger tension adjuster 70 also includes a replacement pin 85 for the factory pin 35 with the replacement pin 85 having a tapped and threaded bore 87 diametrically therethrough. A smooth bore 89 is provided through the front portion 7 of the mounting block 71, including the forward extension 79, so that with the mounting block 71 in place, the bore 89 through the front portion 73 is horizontally aligned with the threaded bore 87 in the replacement pin 85. A screw 91 extending through the front portion 73 of the mounting block 71 and tightened into the threaded bore 87 in the replacement pin 85 secures the mounting block 71 in firm position to the trigger housing 10.

A threaded bore 93 is also provided through the shelf portion 81 of the mounting block 71 so that the longitudinal axis of the bore 93 is approximately perpendicular to its point of intersection with the shoulder 57 of the trigger 50. A spring biased plunger assembly 100 is threaded into the threaded bore 93 of the shelf portion 81 so that the spring biased plunger 95(spring not shown) will bear against the trigger shoulder 57. Thus, the tension of the trigger pull is dependent upon the depth to which the spring biased plunger assembly 100 is threaded into the threaded bore 93.

The mounting block 71 also includes a second threaded bore 96 radially aligned with the longitudinal axis of the plunger assembly threaded bore 93. A set screw 97 threaded into this radial bore 96 can therefore be used to releasably lock the spring biased plunger assembly 100 in its desired position in the mounting block 71. Preferably, the set screw 97 will have a Teflon or Nylon tip to minimize the possibility of damage to the threaded surface of the spring biased plunger assembly 100.

To assemble the trigger tension adjuster 70 to the factory trigger housing 10 is thus seen to be quite a simple task. The original trigger tension pin 53 is popped out of the housing 10 and the replacement pin 85 of the present invention inserted in its place. The mounting block 71 is inserted into position against the rear portion of the trigger housing 10 and locked in place by the screw 91 extending through the smooth bore 89 of the front portion 73 of the mounting block 71 into the threaded tap hole 87 in the replacement pin 85. The spring biased plunger assembly 100 is then threaded into the shelf portion 81 of the mounting block 71 until the plunger 95 firmly contacts the shoulder 57 of the trigger 50.

Adjustment of the tension is also seen to be a simple task. With the set screw 97 in a loosened position, the depth of the spring biased plunger assembly 100 is threadedly adjusted in the mounting block 71 until the desired tension is achieved. Deeper insertion of the assembly 100 would increase the tension while withdrawal of the assembly 100 would decrease the tension. When the proper tension is achieved, the set screw 97 is tightened to lock the assembly 100 in the desired position.

It will readily be noted that the head of the mounting screw 91, the end of the spring biased plunger assembly 100 and the head of the set screw 97 can all be selected so that a single allen wrench can be used to accomplish both assembly and adjustment of the trigger tension adjuster 70.

It will also readily be noted that the configuration of the mounting block 71 can be selected to accommodate the particular configuration of the housing and trigger shoulder of various types of weapons, though this preferred embodiment is designed to conform specifically to housings such as that employed in the TMI Perazzi competition shotgun.

Preferably, the spring of the plunger assembly 100 will be selected to provide tension in the range of two to six pounds over the variable range of plunger depth.

Thus, it is apparent that there has been provided, in accordance with the invention, an erosion retarder that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. In a trigger assembly having a trigger housing and a trigger pivotally mounted thereon, said trigger having a rear shoulder accessible within said housing, the subcombination of a mounting block having a threaded bore therethrough, a spring biased plunger assembly threaded into one end of said bore with its plunger extending beyond the other end of said bore, means for fixing said mounting block to said housing with said plunger in contact with said shoulder throughout a range of motion of said trigger and means for releasably securing said plunger assembly at a selected depth in said mounting block whereby the pull tension of said trigger is adjustable by rotation of said plunger assembly to vary its depth in said mounting block.

2. In a trigger assembly having a trigger housing and a trigger pivotally mounted between side walls thereof, said trigger having a rear shoulder accessible between and rearwardly of said side walls, the subcombination of a mounting block having a front portion contoured for abutment with rear and interior surfaces of said sidewalls and a rear shelflike portion extending in spaced relationship above said trigger shoulder and having a threaded bore extending approximately perpendicular to a portion of an upper surface of said shoulder, means for securing said mounting block front portion in rigid abutment with said rear and interior surfaces of said housing side walls, a spring biased plunger assembly threaded into said bore with a plunger in contact with said trigger shoulder throughout a range of motion of said trigger and a threaded portion extending above said rear portion whereby the pull tension of said trigger is adjustable by rotation of said plunger assembly to vary its depth in said mounting block.

3. A subcombination according to claim 2, said securing means comprising a pin mounted transversely on said housing forward of said mounting block front portion having a diametric threaded aperture therein and a connecting screw extending through said mounting block front portion and threaded into said pin aperture.

4. A subcombination according to claim 2 further comprising an adjustable set screw threaded through said rear, portion of said mounting block to said plunger assembly whereby said plunger assembly is releasably securable at a selected depth in said mounting block.

5. A subcombination according to claim 3 further comprising an adjustable set screw threaded through said rear portion of said mounting block to said plunger assembly whereby said plunger assembly is releasably securable at a selected depth in said mounting block.

6. A subcombination according to claim 5 wherein said trigger tension is adjustable over a range of from 2 to 6 pounds.

7. A subcombination according to claim 4, said set screw having means disposed on the tip thereof for protecting the threaded surface of said plunger assembly.

8. A subcombination according to claim 5, said set screw having means disposed on the tip thereof for protecting the threaded surface of said plunger assembly.

9. In a trigger assembly having a trigger housing and a trigger pivotally mounted thereon, said trigger having a rear shoulder accessible within said housing, the subcombination of a mounting block having a threaded bore therein, a spring biased plunger assembly threaded into said bore with its plunger extending beyond said bore, means for fixing said mounting block to said housing with said plunger in contact with said shoulder throughout a range of motion of said trigger and means for releasably securing said plunger assembly at a selected depth in said mounting block, whereby the pull tension of said trigger is adjustable by rotation of said plunger assembly to vary its depth in said mounting block.

* * * * *